US005857900A

United States Patent [19]

Shank, Jr.

[11] Patent Number: 5,857,900

[45] Date of Patent: Jan. 12, 1999

[54] BLAST NOZZLE CONTAINING WATER ATOMIZER

[75] Inventor: James D. Shank, Jr., Vestal, N.Y.

[73] Assignee: Church & Dwight Co., Inc, Princeton, N.J.

[21] Appl. No.: 567,993

[22] Filed: Dec. 4, 1995

[51] Int. Cl.[6] ..... B24C 5/04

[52] U.S. Cl. ..... 451/102; 451/90

[58] Field of Search ..... 451/102, 90, 39, 451/40

[56] References Cited

U.S. PATENT DOCUMENTS 4,995,202 2/1991 Gardner ..... 51/439

*Primary Examiner*—Robert A. Rose
*Attorney, Agent, or Firm*—Irving F. Fishman

[57] ABSTRACT

A blast nozzle assembly for wet blasting is provided comprising a blast nozzle for accelerating a blast stream of abrasive particles in compressed air toward a targeted surface and in combination therewith, a water atomizer means which is releasibly secured to the exterior of the blast nozzle. The water atomizer means is formed of two parts, a manifold body which includes a water supply means and an outlet assembly which includes a mixing chamber for receiving the blast stream leaving the blast nozzle, a plurality of spaced water nozzles for directing a stream of water into the mixing chamber and an outlet for directing the mixture of blast stream and water to the targeted surface. The outlet assembly further includes a deflecting surface in the mixing chamber so as to deflect the water stream directed into the mixing chamber backwards into the oncoming blast stream and air passages for directing ambient air into the deflected water stream for further atomizing the water stream and providing a shroud of atomized water around the abrasive blast stream as the mixture leaves the outlet assembly. The atomized water shroud surrounding the blast stream controls dust and does not penetrate into the center of the blast stream so as to maintain high productivity for removing contaminants from the targeted surface.

19 Claims, 2 Drawing Sheets

BLAST NOZZLE CONTAINING WATER ATOMIZER

FIELD OF THE INVENTION

The present invention relates generally to blast nozzles and a process for removing adherent material such as paint, scale, dirt, grease and the like from solid surfaces with abrasive particles propelled by air. In particular, the present invention is directed to a blast nozzle containing a means to control dust in the form of a novel water atomizer means which directs an atomized water stream in conjunction with a friable abrasive particle stream at a substrate surface.

DESCRIPTION OF THE PRIOR ART

In order to clean a solid surface to preserve metal against deterioration, remove graffiti, or simply to degrease or remove dirt or other coatings from a solid surface, it has become common practice to use an abrasive blasting technique wherein abrasive particles are propelled by a fluid against the solid surface in order to dislodge previously applied coatings, scale, dirt, grease or other contaminants. Such abrasive blasting is increasingly being used as a replacement for the environmentally hazardous organic solvent cleaning treatments.

Various abrasive blasting techniques have been utilized to remove coatings, grease, dirt and the like from solid surfaces. Thus, blasting techniques comprising dry blasting which involves directing the abrasive particles to a surface by means of pressurized air, wet blasting in which the abrasive blast media is directed to the surface by a pressurized stream of water and a process in which both air and water are utilized either in combination at sufficient pressures to propel the abrasive blast media to the surface as disclosed in U.S. Pat. No. 4,817,342, or in combination in which relatively low pressure water is used primarily as a dust control agent or to control substrate damage. Water for dust control has been mixed with the air and abrasive media either internally in the blast nozzle or externally, and such latter process, although primarily a dry blasting technique, is considered wet blasting inasmuch as media recovery and clean up is substantially different from that utilized in a purely dry blasting operation.

The blast media or abrasive particles most widely used for blasting surfaces to remove adherent material therefrom is sand. Sand is a hard abrasive which is very useful in removing adherent materials such as paint, scale and other materials from metal surfaces such as steel. While sand is a most useful abrasive for each type of blasting technique, there are disadvantages in using sand as a blast media. For one, sand, i.e., crystalline silica, is friable and upon hitting a surface will break into minute particles which are small enough to enter the lungs. These minute silica particles pose a substantial health hazard. Additionally, much effort is needed to remove the sand from the surrounding area after completion of blasting. Still another disadvantage is the hardness of sand itself. Thus, sand cannot readily be used as an abrasive to remove coatings from relatively soft metals such as aluminum or any other soft substrate such as plastic, plastic composite structures, concrete or wood, as such relatively soft substrates can be excessively damaged by the abrasiveness of sand. Moreover, sand cannot be used around moving parts of machinery inasmuch as the sand particles can enter bearing surfaces and the like.

An alternative to non-soluble blast media such as sand, in particular, for removing adherent coatings from relatively soft substrates such as softer metals as aluminum, composite surfaces, plastics, concrete and the like is sodium bicarbonate. While sodium bicarbonate is softer than sand, it is sufficiently hard to remove coatings from metal surfaces and as well remove coatings including paint, dirt, and grease from non-metallic surfaces without harming the substrate surface. Sodium bicarbonate is not harmful to the environment and is most advantageously water soluble such that the particles which remain subsequent to blasting can be simply washed away without yielding environmental harm. Since sodium bicarbonate is water soluble and is benign to the environment, this particular blast media has found increasing use in removing coatings and cleaning dirt, grease and oil and the like from metal and a variety of other surfaces.

Sodium bicarbonate, however, is also a friable abrasive and will break into smaller particles as it traverses the flexible supply hose which carries the blast media and pressurized air to the blast nozzle and, as well, break into pieces as the blast media comes into contact with the internal surfaces of the blast nozzle prior to being propelled to the target surface. As the sodium bicarbonate media contacts the surface to be treated, even smaller particles are formed yielding a substantial amount of dust which invades the targeted area and closely surrounding environment, hindering the operator's vision of the targeted surface. Accordingly, it has become necessary to control the dust which is formed upon blasting with sodium bicarbonate blast media.

As expressed above, wet blasting techniques have been used to control the amount of dust formed during blasting with friable abrasives. Wet blasting has been accomplished by two distinct methods. In the first, using water only as the pressurized fluid to carry the abrasive, much water is consumed and specialized equipment is typically needed to provide the water pressures needed. Slurry blasting at low pressure has been useful for blast cabinet cleaning. In the other method, water has been added to a pressurized air stream. Several water addition techniques have been used. In one method, the blast nozzle is provided with a water port in which water is injected into the blast nozzle to mix with the air stream and entrained blast media particles. This method has been very effective in controlling the amount of dust produced from the friable abrasive particles in the surrounding work zone subsequent to abrasive contact with the targeted surface. Unfortunately, for a low density, water soluble abrasive such as sodium bicarbonate, the velocity of the media particles is reduced by the water and consequently, the productivity with respect to cleaning the targeted surface is substantially decreased by this wet blasting method. Thus, defining performance of a blast nozzle as a rate in which a volume of coating is removed per time, injecting the water with the air stream which propels the blast media has greatly reduced the production rate for the reasons expressed above.

An alternative method of wet blasting has been to direct the water stream externally from the blast nozzle to either impinge the blast stream to wet the abrasive as in internal injection or direct the water stream at the targeted surface to control the dust which forms at the contact point. Wetting the abrasive outside the nozzle has the same adverse effect on productivity as internal water injection. Directing the water stream against the targeted surface has yielded improved productivity relative to the internally directed water stream, however, dust control is only slightly improved relative to dry blasting and substantially inferior to the process in which the water stream is directed internally in the blast nozzle inasmuch as it is difficult for externally applied water to effectively "wet" the dust.

An alternative blast nozzle used for the latter type of wet blasting process has been developed by the present assignee and is described in U.S. Pat. No. 5,319,894. As disclosed therein, the blast nozzle is provided with an external source of atomized water which is directed at the targeted surface so as to control the formation of dust. The atomized water is achieved by an atomization nozzle in which air and water are mixed and directed from the nozzle in drops having a diameter of about 15–200 microns or less. The atomized water is directed at the targeted surface at a location to meet deflected abrasive media particles which have contacted the targeted surface and coalesces or otherwise precipitates the minute particles of blast media, thus reducing the dust which is formed. The atomized water droplets more effectively wet the dust particles relative to substantially coalesced externally applied water streams. At the same time, the minute atomized water particles provided at low pressure and externally from the blast nozzle do not substantially interfere with the media flow from the blast nozzle to the targeted surface and, thus, maximum velocity of the blast media is substantially maintained and productivity for stripping or cleaning the targeted surface is maintained at high levels, approaching those levels achieved for purely dry blasting operations.

The use of the single tip water atomizer, however, has not always been successful in maintaining dust control as the atomized water stream does not fully surround the abrasive media stream. An improvement on the blast nozzle as disclosed in U.S. Pat. No. 5,319,894 is described in commonly assigned U.S. patent application Ser. No. 08/169,774, filed Dec. 17, 1993. As disclosed therein, the single tip water atomizer is replaced with three water atomizers placed around the outlet of the blast nozzle to provide a shroud of atomized water which surrounds the abrasive blast stream without substantially interfering with the abrasive so as to maintain dry blasting productivity and greatly improved dust control. Still, improvements can be made inasmuch as the addition of three water atomizers to the blast nozzle adds weight to the hand held device, requires more complex air and water piping to supply each atomizer, and a constant supply of compressed air to feed the atomizer tips, adding to the cost of operation.

U.S. Pat. No. 4,995,202 discloses a blast nozzle for wet blasting of the internal water injection type so as to provide dust control and still maintain productivity. The nozzle unit is formed from two nozzle bodies which are joined together, each of which has a venturi structure. Inside the nozzle unit is an annular cavity which is connected to a source of water and a mixing chamber. The nozzle unit has air passages which connect the mixing chamber with air surrounding the nozzle unit. In operation, the abrasive material is directed into the mixing chamber where it mixes with water and air drawn from the outside to form a wet abrasive stream. While this patent utilizes an atomized water stream, the mixture of the water with the abrasive can still adversely affect productivity, especially if a low density abrasive such as sodium bicarbonate is utilized. Moreover, control over the degree of atomization is minimal at best. A substantially greater interchangeability and variability would be useful to accommodate changing conditions at a blast cleaning site.

Accordingly, there is still a need to provide an improved blast nozzle for use in wet blasting which can achieve the productivity of dry blasting and yet provide adequate dust control.

It is another object of the present invention to provide a blast nozzle for wet blasting which can achieve effective productivity with many types of abrasives including sand and less dense abrasives such as sodium bicarbonate and provide cost effective dust control.

Still another object of the present invention is to provide an improved blast nozzle for use in wet blasting which can also be readily converted for convenient use in dry blasting.

These and other objects of the present invention can be readily discerned from the description of the invention set forth below and in the appended claims.

SUMMARY OF THE INVENTION

The present invention is directed to a novel blast nozzle assembly and method of use for wet blasting to clean contaminants such as paint, rust, scale, dirt, grease, and the like from substrate surfaces. The nozzle is capable of directing any type of abrasive whether a hard friable abrasive such as sand or a less dense abrasive such as sodium bicarbonate, but is particularly useful for blasting with the softer abrasives which are more adversely affected by contact with an added water stream used for dust control. The blast nozzle assembly of the present invention comprises a venturi-type blast nozzle which has threaded onto the exterior outlet end thereof, an atomization tip comprising an annular manifold for providing a water supply to a plurality of water jet holes which surround the perimeter of the blast stream as the stream exits the blast nozzle. The water jets are positioned so as to direct a stream of water into an atomization chamber beyond the outlet of the blast nozzle and in the same direction as the blast stream. Each water jet impacts a flat surface perpendicular to the blast stream so as to diffuse and deflect the water into the blast stream exiting the blast nozzle. The atomization tip further includes air holes positioned so as to intersect the water jets around the perimeter of the atomization chamber. Air is drawn into the atomization chamber through the air holes by a vacuum generated as the blast stream exits a short venturi outlet downstream of the atomization chamber. The dispersed water droplets deflected into the atomization chamber are impacted by ambient air and further atomized. The atomized water/air mixture is drawn out of the atomization tip as the blast stream passes therethrough. The atomized water/air mixture shrouds the blast stream and disperses to collide with dust generated while blasting. The dust particles become wetted and fall to the ground providing good dust control. Importantly, the dispersed water droplets are not readily mixed with the interior of the blast stream and, thus, do not decrease the velocity of the abrasive particles. Accordingly, productivity of the blast nozzle is maintained at high levels.

DETAILED DESCRIPTION OF THE INVENTION

Figure 1:
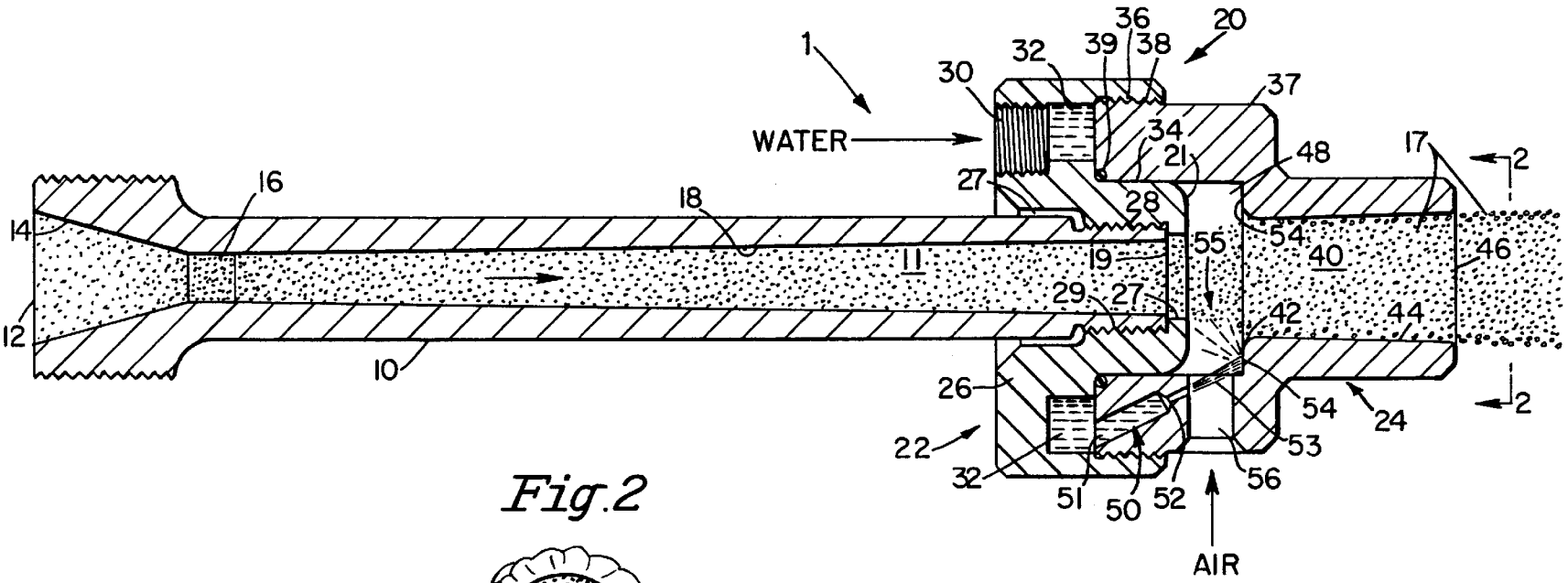
FIG. 1 is a cross section of the blast nozzle with water atomizer of the present invention.

FIG. 1 illustrates the improved blast nozzle and combined water atomizer of this invention. As shown therein, the nozzle assembly 1 of this invention includes a blast nozzle 10 exemplified by a round venturi-type nozzle containing a bore 11 formed therein defining a longitudinal axis. Bore 11 includes an inlet portion 12 which is part of converging surface 14, a throat 16 and a diverging surface 18 which terminates at outlet 19. The venturi effect formed by the juxtaposed surfaces 14, 18 and throat 16 serves to increase the velocity of blast media stream 17 (an abrasive/pressurized air mixture) out of outlet 19 of blast nozzle 10 to an extremely high velocity effective to clean or remove adhered coatings, scale, dirt, etc. from the surface being targeted. For protection against the eroding effects of the blast media, on the interior surfaces of the blast nozzle protective inserts or coatings (not shown) may be advantageously provided on surfaces 14 and 18 and within throat area 16. Such coatings or inserts may advantageously comprise ceramics such as tungsten carbide or silicon nitride as erosion resistant materials. Tempered or stainless steel may also be used to form the blast nozzle.

To suppress the formation of dust which forms upon the contact of the abrasive media with the contaminated surface, there is provided in nozzle assembly 1 of the present invention a water atomization tip 20. Water atomization tip 20 contains two parts, a manifold 22 for supplying water and a venturi outlet assembly 24. Manifold 22 comprises a body 26 which contains an open-ended nozzle receiving bore 27 which extends centrally through manifold body 26. Bore 27 contains internal threads 28 which mate with external threads 29 on and adjacent the outlet 19 of nozzle 10. Body 26 is thus threaded onto the exterior of nozzle 10 to secure manifold 22 to nozzle 10. When received in bore 27, outlet 19 of blast nozzle 10 is located adjacent to end surface 21 of manifold body 26.

Manifold body 26 includes a water inlet port 30 which can be secured to a pressurized water source. Water inlet port 30 feeds an annular water manifold or water distribution chamber 32. Also, placed within manifold body 26 is an annular chamber 34 for receiving the inlet end of venturi outlet assembly 24. Present on the inner wall of chamber 34 are threads 36 which mate with external threads 38 on the inlet shroud 37 of venturi outlet assembly 24. An o-ring 39 seals shroud 37 of venturi outlet assembly 24 in water tight configuration with manifold body 26.

Venturi outlet assembly 24 includes a central bore 40 which extends lengthwise entirely therethrough. Bore 40 has a shortened venturi structure including a slight converging surface portion 42 and a diverging surface 44 which extends to an outlet 46 and preferably has the same taper as surface 18. Diverging surface 44 is no longer than 1.5 to 3 times the diameter of outlet 19 of nozzle 10. Bore 40 has an inlet diameter about 10 to 25% larger than the diameter of outlet 19 so as not to disturb the exiting blast stream 17. A widened mixing chamber 48 is formed upstream of bore 40 and encloses and receives the blast stream leaving outlet 19 of nozzle 10 and nozzle receiving bore 27 in manifold body 26.

Venturi outlet assembly 24 also includes a plurality of water jets 50 circumferentially spaced in shroud 37 of assembly 24 for receiving water from annular chamber 32 and injecting the water into mixing chamber 48. Each jet 50 includes a water receiving channel 51 in communication with water distribution chamber 32 and a narrow nozzle portion 52 which communicates with channel 51 and directs a stream 53 of water into mixing chamber 48. Four to eight water jets 50 are preferred for providing the atomized water stream around the blast stream exiting nozzle 10. Preferably, water jets 50 are positioned to direct the water stream 53 into atomization chamber 48 at a 25° angle relative to the longitudinal axis of nozzle assembly 1 and in the same direction of flow as the blast stream exiting nozzle 10. Importantly, the water jets 50 are positioned so that the stream 53 of water exiting nozzles 52 impacts on inner annular surface 54 which surrounds the converging inlet surface 42 of bore 40. Annular surface 54 is substantially flat and is perpendicular to the longitudinal direction of the blast stream leaving nozzle 10. As each stream 53 of water from water jets 50 impact on flat surface 54, the water streams are diffused into droplets 55 which are deflected backwards into the oncoming blast stream at an angle approximating 65°.

To enhance the dispersal and atomization of the water streams, assembly 24 further includes air through-holes 56 placed through shroud 37 and spaced around thereof for directing air from the ambient atmosphere into the mixing chamber 48. Ambient air is drawn into mixing chamber 48 by the vacuum generated as the blast stream exits outlet 46 of venturi outlet assembly 24. Air holes 56 are sized so as to not restrict the induced incomming air flow, i.e., sum total area of all air holes is at least 2.5 times the area of outlet 19. The air drawn into the atomization chamber 48 further diffuses and atomizes the deflected water droplets 55. The diffused and at least partially atomized deflected water droplets 55 are impacted by the perifery of the blast stream exiting outlet 19 of nozzle 10. The atomized water and air mixture shrouds the blast stream leaving outlet 46 and disperses to collide with dust generated while blasting. The air holes 56 and water nozzles 52 are preferably staggered around shroud 37 so as to insure the water stream contacts surface 54 before contact with the air drawn into the mixing chamber 48 through air holes 56.

Figure 2:
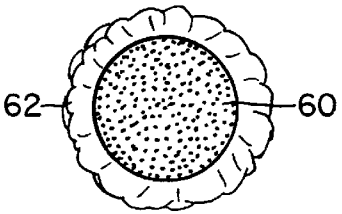
FIG. 2 is a cross-section of the blast stream leaving the blast nozzle of this invention taken along line 2—2 of FIG. 1.

Since the water streams 53 leaving nozzles 52 are first deflected, dispersed and atomized prior to and during contact with the blast stream, the water droplets are not heavy or sufficiently cohesive to readily penetrate the blast stream. Accordingly, the central portion of the blast stream remains dry. This is shown in FIG. 2 in which the blast stream 60 is surrounded by the atomized water and air shroud 62. By maintaining the central portion of the blast stream dry, the productivity for stripping contaminants from the substrate surface can approach dry blasting productivity. With a relatively light abrasive media such as sodium bicarbonate, previous attempts to add water to the blast stream have greatly reduced the velocity and consequently greatly reduced the productivity of the blast stream for stripping contaminants from the surface. The present nozzle assembly avoids the reduction in productivity and at the same time greatly improves dust control.

The blast nozzle containing the novel water atomizer of the present invention can be advantageously used with any type of friable blast media. Thus, while it has been disclosed that the blast nozzle of the present invention is most useful with soft friable blast media such as sodium bicarbonate, the blast nozzle apparatus is also useful with hard friable blast media such as sand. Thus, the blast nozzle apparatus is useful to control the silica dust which results upon blasting with sand. Moreover, the blast nozzle apparatus of this invention is useful to remove coatings, scale and the like from any type of surface including the softer surfaces described above such as soft metals including aluminum and plastic surfaces and, as well, hard surfaces such as hard metals including steel. The particular configuration of the blast nozzle, per se, can be changed without adversely affecting the improvements found with the water atomizer to control dust. Thus, although the standard round nozzle is disclosed and illustrated in the accompanying figures, it is to be well understood that other configurations of blast nozzle can be used with equal advantage. Importantly, since manifold 22 and assembly 24 are threaded onto nozzle 10, these structures can be removed and the nozzle used for dry blasting without altering the configuration of the nozzle.

It has been further found that optimal productivity for blast cleaning a surface with a softer, less dense blast media such as sodium bicarbonate can be achieved by a venturi-type blast nozzle 10 if the outlet length, that being the length of the venturi-type nozzle immediately downstream of the orifice (throat) to the outlet of the nozzle is approximately 20 times the diameter of the orifice. Thus, it has been found that an outlet length which is 18 to 24 times the orifice diameter provides optimal productivity. At outlet lengths below the range just cited, productivity is adversely affected. At lengths above the range, productivity is no longer improved or may be adversely affected. Along with the outlet length, optimal productivity is achieved if the outlet diameter is approximately 1.5 times the orifice diameter. Deviations of more than 10% below this parameter adversely affects productivity. Thus, the outlet diameter should be at least 1.35 times the orifice diameter. Deviations above 1.65 times the orifice diameter do not show benefits at media flow rates typically used to blast with sodium bicarbonate, i.e., 0.5 to 5 lbs./min. At higher flow rates, larger nozzle outlets may show productivity improvements.

With softer and friable blast media, passage through the converging inlet section of the venturi-type blast nozzle often degrades the particles of the media, creating particles of smaller mass and often causing turbulent flow in the inlet section thereby reducing the velocity of the particles as they travel through the blast nozzle. The loss of mass and velocity reduces the force of the particle on the targeted surface and, thus, can reduce productivity of the nozzle. Thus, the converging inlet section of the nozzle should converge at a relatively minor angle, typically from between about 5° to 15° from horizontal, preferably, approximately 10°. To further eliminate turbulent flow, the diameter of the inlet should be approximately equivalent to the inside diameter of the blast hose which supplies the blast media to the nozzle. Preferably, the inlet diameter should not deviate more than approximately 25% plus or minus from the inlet diameter of the supply hose. The longitudinal length of the orifice is optimum at lengths about equivalent to the orifice diameter. Larger orifice lengths have not been found to yield any significant improvement in productivity.

While stainless steel nozzles can be used to direct a soft media such as sodium bicarbonate to a targeted surface, for certain applications, it is useful to include a minor amount of a hard abrasive with the softer bicarbonate abrasive or use a hard abrasive exclusively. Thus, the present assignee has developed a blast media which comprises a major amount of a soft abrasive such as sodium bicarbonate with a minor amount of a hard abrasive such as aluminum oxide to remove contaminants from steel surfaces. The hard abrasive allows a profile to be placed on the targeted surface which can then be repainted. Unfortunately, hard abrasives even if present in minor amounts tend to erode the internal surfaces of a stainless steel nozzle. Accordingly, the present invention is also directed to a blast nozzle formed of a hard ceramic substance having the parameters described above. Thus, the interior surface of the blast nozzle can be formed from tungsten carbide, silicon carbide, boron carbide, silicon nitride, etc. or any other hard ceramic material which is abrasion resistant especially to hard blast media such as sand, aluminum oxide, and other ceramic blast media.

A particularly preferred blast nozzle is formed from reaction bonded silicon nitride. Briefly, the silicon nitride nozzle is made from a packing mixture consisting of silicon nitride powder and a densification aid selected from a group of materials consisting of magnesium oxide, yttrium oxide, cerium oxide and zirconium oxide. The processes for forming reaction bonded silicon nitride articles are disclosed in U.S. Pat. Nos. 4,235,857; 4,285,895; 4,356,136; 4,377,542; and 4,388,414, all assigned to Ford Motor Co and incorporated herein by reference. A particular useful nozzle is a reaction bonded silicon nitride nozzle formed by Ceradyne, Inc., Costa Mesa, Calif., under the tradename Ceralloy 147-31 E.

While the nozzle parameters as described above have been optimized for improving blast cleaning with a soft media such as sodium bicarbonate, the formation of blast nozzles from a hard ceramic allow such nozzles to be used for blast cleaning with harder, more dense substances either added with the softer abrasive or as the sole abrasive agent. It is believed that the parameter for nozzle outlet length as described above will improve productivity of blast cleaning using the harder, more dense abrasive media even though the exact ratios of nozzle length to orifice diameter, outlet diameter to orifice diameter, etc. as described above may not yield the most optimum productivity with these abrasives.

The parameters, as above described, define a nozzle having a circular cross-section of specified orifice and outlet areas and angle of divergence in the outlet section. Accordingly, the dimensions of a nozzle of any cross-section can be calculated based on the described ratios.

EXAMPLE

In this example, the blast cleaning productivity of a nozzle assembly in accordance with the present invention was compared relative to the cleaning productivity of a dry blast nozzle and the wet blasting nozzle assembly as described in U.S. Pat. No. 4,995,202. This latter nozzle is similar to the nozzle of the present invention except that the atomization chamber is permanently fixed in the center of the nozzle which is fed with water from larger jets positioned parallel to the blast stream. The second venturi or outlet section has a similar length than the initial venturi section and is designed to spread the blast pattern into a larger hot spot as well as draw air into the atomization chamber through holes positioned 120° to the blast stream. What results is that the water streams enter the atomization chamber and mix thoroughly with the blast stream and, thus, wet the abrasive media in the center and throughout the blast stream.

Figure 3:
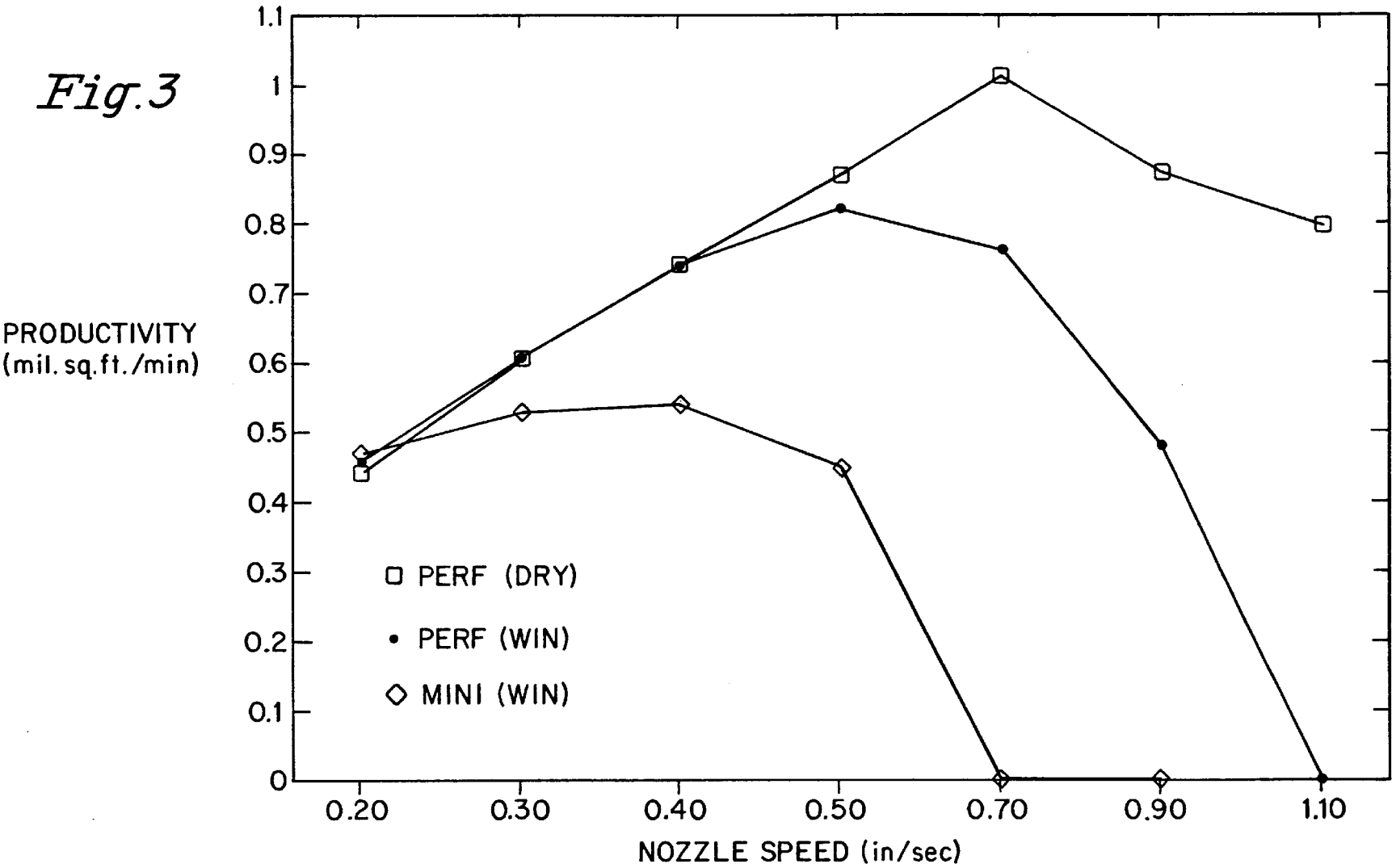
FIG. 3 is a graph showing the blast cleaning productivity of various blast nozzle assemblies including that of the present invention.

Each blast nozzle tested had a ¼ inch orifice in the initial venturi. The nozzle of the present invention and the dry blast nozzle were identical, each having an outlet length of 5 in. The length of the second venturi in the atomization tip was 1 in. The length of the venturi in the first nozzle body used as described in U.S. Pat. No. 4,995,202 was 1 in. as measured from the orifice and likewise the venturi in the second nozzle body was approximately 1 in. long. The media was sodium bicarbonate which was directed through each nozzle at 1.1 lb. per minute. The nozzles were used to remove 7–9 ml. epoxy film on steel. The standoff distance of each nozzle from the steel substrate was 10 in. at about a 60° angle. Wet blasting was accomplished by an X-Y table with a nozzle speed ranging from 0.2 in./per second to 2.4 in./per second. Productivity was determined by measuring the fully cleaned width of the blast pattern and calculating the volume of paint removed per time. The results are shown in FIG. 3.

What was found was that the nozzle assembly of the present invention increased productivity over the comparative wet blasting nozzle by about 64%. Although dust control was not able to be measured visual observation showed that dust control was equivalent for both nozzles.

What is claimed is:

1. A blast nozzle and water atomizer combination for directing a blast stream of abrasive particles against a targeted surface for the removal of surface contaminants therefrom comprising:

a blast nozzle including a first longitudinal bore shaped to accelerate a stream of abrasive particles from an inlet of said blast nozzle to an outlet thereof, and a water atomizer means attached to the exterior of said blast nozzle, said water atomizer means including a water inlet and means to direct water from said water inlet past said blast nozzle outlet for contact with said blast stream exiting said outlet, said water atomizer means further including a second longitudinal bore aligned with said blast nozzle outlet and comprising a second outlet and a mixing chamber disposed intermediate said blast nozzle outlet and said second outlet, said means to direct water from said water inlet for contact with said blast stream including water nozzle means to direct water from said water inlet into contact with a deflecting surface in said mixing chamber so as to produce water droplets which are deflected backwards into said blast stream, and further including at least one air passage communicating with said mixing chamber whereby air drawn in through said at least one air passage contacts said deflected water droplets to atomize said water droplets so as to form a shroud of atomized water around said blast stream directed from said second outlet to said targeted surface, said water atomizer means further comprising a manifold body containing said water inlet, and an outlet assembly containing said second longitudinal bore therethough, said water nozzle and said air passage, said outlet assembly being threaded onto said manifold body and said manifold body being threaded onto the exterior of said blast nozzle.

2. The combination of claim 1 wherein said at least one air passage is open to the immediate ambient air around said water atomizer means.

3. The combination of claim 1 wherein said water atomizer means is releasibly threaded onto the exterior of said blast nozzle.

4. The combination of claim 2 wherein the total area of said air passages is at least 2.5 times the area of said blast nozzle outlet.

5. The combination of claim 1 wherein said manifold body contains a hollow bore therethrough to receive said blast nozzle and a threaded annular chamber to receive said outlet assembly.

6. The combination of claim 5 wherein said deflecting surface in said mixing chamber is perpendicular to a longitudinal axis of said first bore.

7. The combination of claim 6 wherein said deflecting surface is flat.

8. The combination of claim 1 wherein said first longitudinal bore includes a converging inlet, a diverging outlet and a venturi orifice intermediate said converging inlet and said diverging outlet, said second longitudinal bore being on a longitudinal axis with said first longitudinal bore of said blast nozzle.

9. The combination of claim 8 wherein said second longitudinal bore comprises a diverging outlet section, the diverging outlet section of said second longitudinal bore having a length no more than 3 times the diameter of the venturi orifice of said first longitudinal bore.

10. The combination of claim 9 wherein the length of the diverging outlet section of said second longitudinal bore is no more than 1.5 times the diameter of the venturi orifice of said first longitudinal bore.

11. The combination of claim 1 wherein said water atomizer means includes a plurality of said water nozzles.

12. The combination of claim 1 wherein said water atomizer means includes a plurality of said water nozzles.

13. The combination of claim 12 wherein said outlet assembly includes an open ended circular shroud which is threaded to said manifold body, said circular shroud containing a plurality of said water nozzles spaced around the circumference thereof and a plurality of said air passages spaced around said shroud.

14. The combination of claim 11 wherein said water atomizer means comprises 4 to 8 water nozzles.

15. The combination of claim 12 wherein said water atomizer means comprises 4 to 8 water nozzles.

16. The combination of claim 13 wherein said water nozzles and air passages are staggered around the circumference of said shroud.

17. The combination of claim 9 wherein said diverging outlet section of said second longitudinal bore has the same taper as said diverging outlet of said first longitudinal bore.

18. The combination of claim 17 wherein said second longitudinal bore has an inlet diameter about 10 to 25% larger than the diameter of the outlet of said first longitudinal bore.

19. The combination of claim 8 wherein the length of said diverging outlet of said first longitudinal bore is about 20 times the diameter of said venturi orifice.

* * * * *